US006626774B2

(12) United States Patent
Sorbie

(10) Patent No.: US 6,626,774 B2
(45) Date of Patent: Sep. 30, 2003

(54) STRINGLESS SPORTS RACQUET

(76) Inventor: Neil Sorbie, 27 Wood Glen Road, Toronto, Ontario (CA), M1N 2V6

( * ) Notice: Subject to any disclaimer, the term of this patent is extended or adjusted under 35 U.S.C. 154(b) by 0 days.

(21) Appl. No.: 10/256,142

(22) Filed: Sep. 27, 2002

(65) Prior Publication Data

US 2003/0073521 A1 Apr. 17, 2003

(30) Foreign Application Priority Data

Oct. 17, 2001 (CA) ..... 2359153

(51) Int. Cl.[7] ..... A63B 49/00; A63B 59/00

(52) U.S. Cl. ..... 473/524; 473/528; 473/516; 473/513; 473/510; 473/505

(58) Field of Search ..... 473/505, 510, 473/511, 512, 513, 516, 524, 527, 528

(56) References Cited

U.S. PATENT DOCUMENTS 753,946 A * 3/1904 Wharton ..... 473/510
1,866,158 A * 7/1932 Goodwin ..... 473/513
2,039,138 A * 4/1936 Auer ..... 473/513
2,670,958 A * 3/1954 Leiser et al. ..... 473/513
2,710,753 A * 6/1955 Lockwood ..... 473/513
3,048,399 A * 8/1962 Breitbach ..... 473/457
3,734,499 A * 5/1973 Goldstein ..... 473/528
3,871,653 A * 3/1975 Sambos ..... 473/513
3,992,008 A * 11/1976 Watkin ..... 473/513

* cited by examiner

*Primary Examiner*—Raleigh W. Chiu
(74) *Attorney, Agent, or Firm*—Riches, McKenzie & Herbert LLP

(57) ABSTRACT

A stringless sports racquet made from a used stringed racquet comprises a handle, a head frame, a flexible scoop provided on a back side of the head frame for catching, tossing, and scooping up a ball, and a flexible crosspiece provided across a back side of the flexible scoop. The flexible sheet defines at least a ramp portion along which a ball can be rolled.

29 Claims, 4 Drawing Sheets

STRINGLESS SPORTS RACQUET

FIELD OF THE INVENTION

The present invention relates to a modified sports racquet for use in a catch and throw ball game and, in particular, to a modified racquet made from a stringless racquet, such as a used, stringless, badminton racquet.

BACKGROUND OF THE INVENTION

Many racquet games use a hand held racquet which is used to propel the object to be hit, toward an opponent. In order to propel the object, strings are tightly strung across the head of the racquet which gives sufficient force to the object when hit to propel it towards the opponent.

Examples include the game of tennis, the game of badminton or the game of squash. Each game uses a racquet with a head at the end of a handle which carries a surface of a tightly wound string across the head of the racquet which is used to propel the ball, the birdie or the squash ball toward the opponent.

Other sports use variations of such a racquet. For example, lacrosse is a game of ball, originating from the North American Indians, now the popular field sport of Canada, and played also in the United States and in England. The game is played on a field by two teams of ten players each. Each player carries a long-handled racquet, called a "crosse". The ball is not handled but caught with the crosse and carried on it, or tossed from it, the object being to carry it and throw it into the opposing team's goal.

Conventional lacrosse racquets have a head portion which defines an opening within which is mounted a net to form a scoop-shaped pocket. In the past the head portions of the lacrosse racquets have been formed of wood or other materials. More recently, plastic heads are customarily used.

With these racquets, if the net or string is broken, the service of a professional stringer equipped with special stringing machine is needed to repair the net. The cost of replacing the entire net is expensive. This is the same for all kinds of racquets such as badminton racquets, squash racquets, and tennis racquets, etc. When the strings of these racquets are broken, the service of a professional stringer equipped with special stringing machine will be needed to replace and tighten the strings. These used racquets with broken strings are often put away and become useless items.

SUMMARY OF THE INVENTION

It is an object of the present invention to produce a scoop-shaped pocket for use in combination with a racquet frame.

It is another object of the present invention to produce a useful racquet made from used stringless badminton, squash, tennis, or other kinds of racquets.

It is another object of the present invention to recycle used racquet frames.

It is yet another object of the present invention to provide a method of producing a racquet for use in a catch and throw ball game.

According to one aspect of the invention, there is provided a racquet comprising a handle and a head frame, the head frame having a proximal end portion connected to the handle and a distal end portion; a flexible scoop provided on one side of the head frame, the flexible scoop defining a central pocket; and a flexible crosspiece extending across the distal end portion of the head frame for supporting a distal end portion of the flexible scoop on a back side thereof, wherein the flexible scoop defines a first ramp portion along which a ball can be rolled outwardly from the central pocket and towards the head frame, and wherein the distal end portion of the flexible scoop, being supported by the flexible crosspiece, defines a second ramp portion extending from the first ramp portion along which the ball can be rolled continuously from the first ramp portion, along the second ramp portion, and towards a distal end of the head frame.

According to another aspect of the invention, there is provided a racquet comprising a handle and a head frame, the head frame having a proximal end portion connected to the handle and a distal end portion; a flexible sheet being longer and wider than the head frame and having string receiving apertures provided along a peripheral portion thereof, the flexible sheet being fastened within the head frame, thereby forming a flexible scoop on one side of the head frame for catching and throwing a ball; and a flexible crosspiece extending across the distal end portion of the head frame for supporting a distal end portion of the flexible scoop on a back side thereof, wherein the flexible scoop and the flexible crosspiece define at least a ramp portion along which a ball can be rolled.

According to yet another aspect of the invention, there is provided a flexible scoop device for use in combination with a racquet frame, the racquet frame having a handle and a head frame, and the head frame having a proximal end portion connected to the handle and a distal end portion, the flexible scoop device comprising a flexible scoop portion being formed by folding and stitching a flexible sheet which is longer and wider than the head frame; a flexible crosspiece portion both ends of which being stitched to respective opposite edges of the flexible scoop portion, thereby forming generally a headband portion adapted to fit around the head frame at the distal portion thereof for holding the flexible scoop portion in a predetermined position relative to the head frame; and a plurality of string receiving apertures provided along a peripheral folded portion of the flexible scoop portion, whereby the flexible scoop portion is fastened to the head frame by means of a string.

According to a further aspect of the invention, there is provided a method of producing a useful racquet comprising the steps of providing a stringless racquet with a handle and a head frame having a proximal end portion and a distal end portion; providing a flexible sheet with string receiving apertures formed along a peripheral portion thereof, the flexible sheet being longer and wider than the head frame; folding and stitching at least a portion of the flexible sheet together to form a flexible scoop; stitching both ends of a flexible crosspiece to opposite edges of the flexible scoop thereby forming generally a headband portion; fitting the headband portion around the head frame from the distal end portion thereof thereby holding the flexible scoop in a predetermined position relative to the head frame; and fastening the flexible scoop to the head frame by means of a string.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
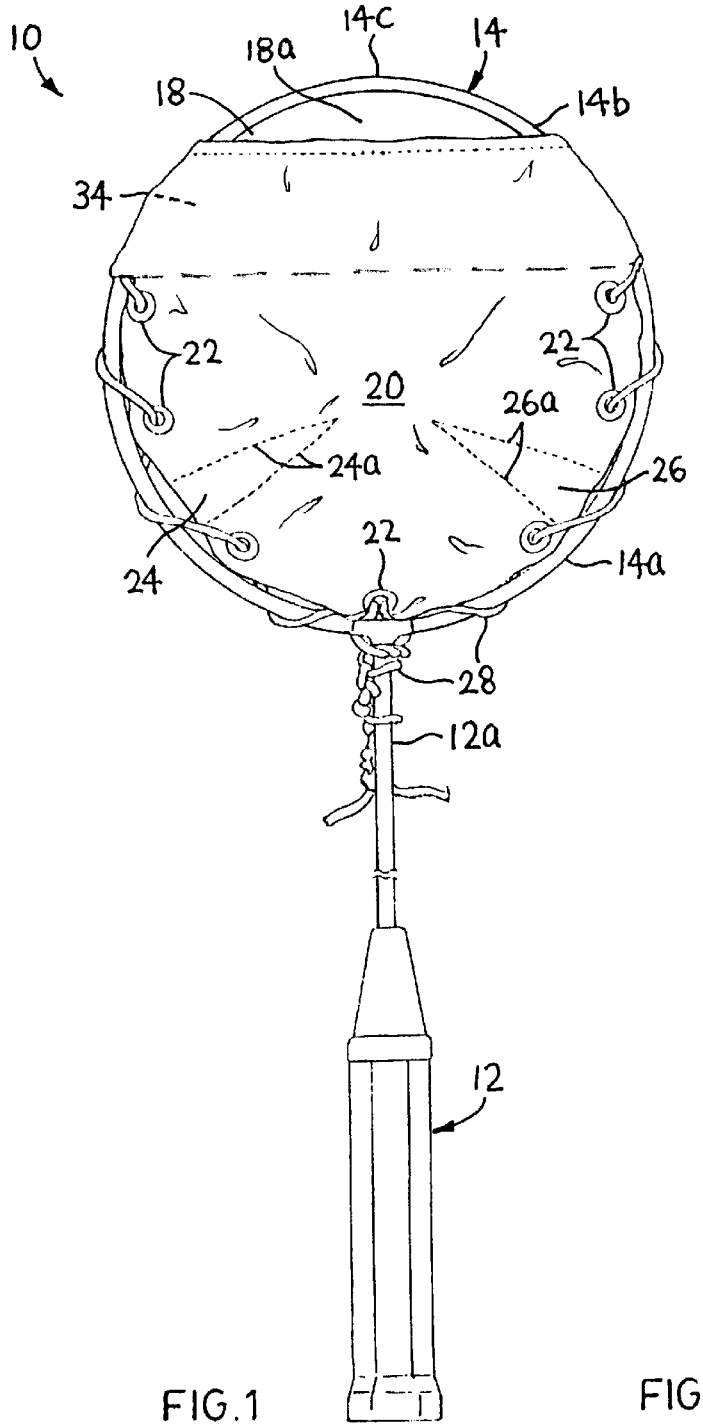
FIG. 1 is front elevational view of a racquet in accordance with a preferred embodiment of the present invention.

Referring now in more detail to the drawings, in which like reference numerals represent like parts throughout the several views, FIG. 1 shows a preferred embodiment of a racquet of the present invention designated generally by reference numeral 10. In the present embodiment, a used stringless badminton racquet is used. However, it is understood that other used stringless racquets such as squash racquets, or tennis racquets, etc. can also be used. Furthermore, it is appreciated that a newly designed racquet frame can also be used.

The racquet 10 has a handle and a head frame generally represented by reference numerals 12 and 14 respectively. The head frame 14 is a stringless head frame of a used badminton racquet. The head frame has a proximal end portion 14*a*, being connected to the handle 12, and a distal end portion 14*b*. The head frame 14 is provided with string receiving apertures 16 and defines a central opening 18. The head frame 14 may be made of wood, plastic, or metal, and may be generally circular, or oval, or other shapes.

According to the preferred embodiment, a flexible sheet 20, preferably made of nylon, is used to substantially cover the central opening 18 defined by the head frame 14, except for a distal end opening 18*a* provided at the distal end portion 14*b* of the head frame 14. The flexible sheet 20 is longer and wider than the head frame 14. A plurality of string receiving rings 22 is provided along a peripheral folded portion 36 of the flexible sheet 20. The rings 22 may be made of plastic or metal.

Figure 3:
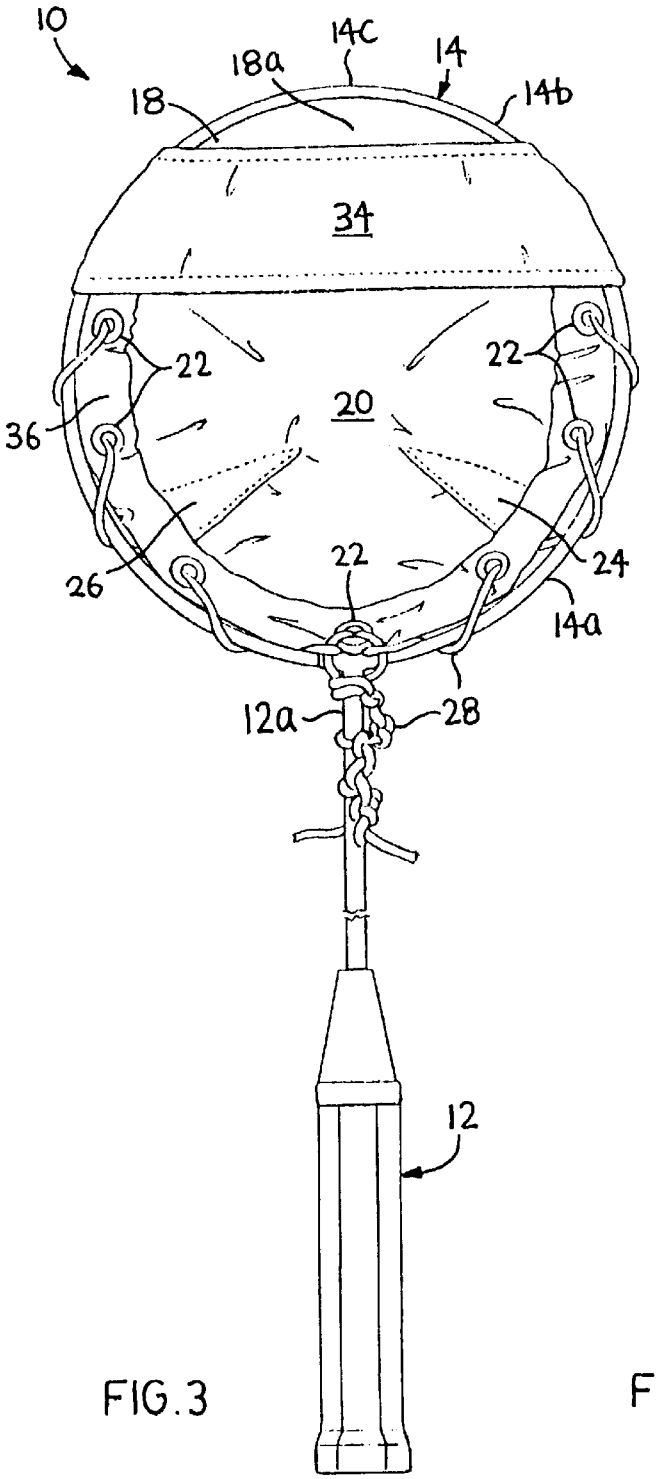
FIG. 3 is a rear elevational view of the racquet of FIG. 1.

A string 28 is used to tie the flexible sheet 20 to the head frame 14, as best illustrated in FIGS. 1 and 3. The string 28 is threaded through a ring 22, then wound around a section of the head frame 14, and then threaded through an adjacent ring 22 until all the rings 22 are threaded. Both ends of the string 28 are then tied firmly together into knots at a proximal end 12*a* of the handle 12 so that the ends of the string 28 do not interfere with the catching and throwing of a ball during a catch and throw ball game.

Figure 2:
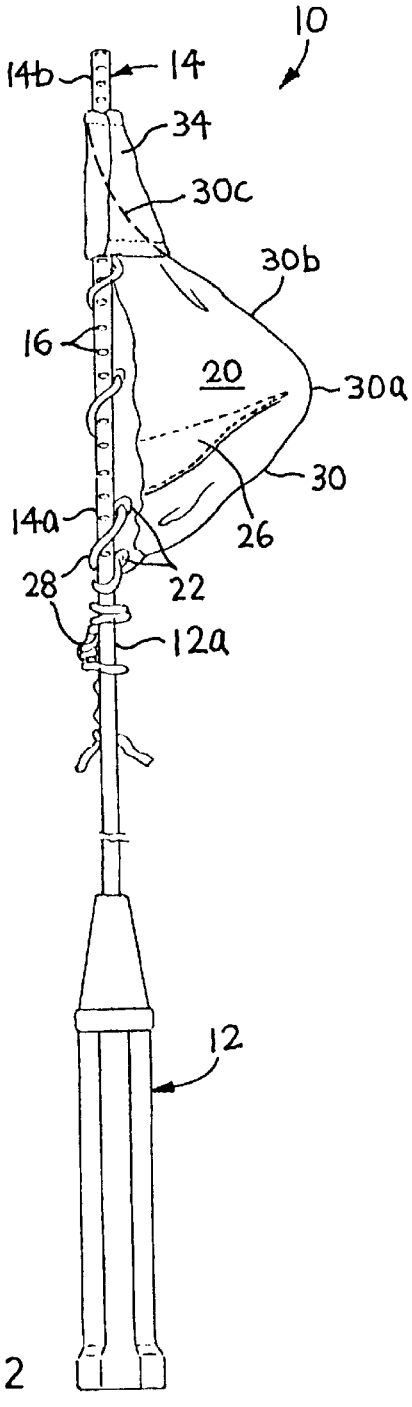
FIG. 2 is side elevational view of the racquet of FIG. 1.
Figure 4:
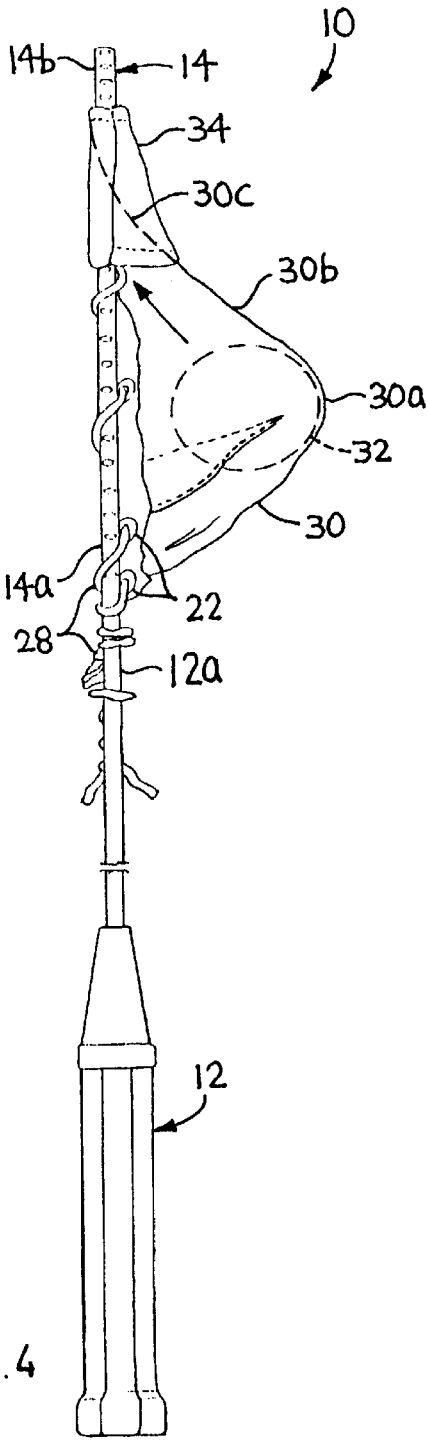
FIG. 4 is a similar side elevational view of FIG. 2 showing the direction of movement of a ball from a scoop-shaped pocket of the racquet.

When the flexible sheet 20 is tied to the head frame 14, a flexible scoop-shaped pocket or scoop 30 is formed on one side or a back side of the head frame 14, as illustrated in FIGS. 2 and 4. In accordance with the present embodiment, the flexible scoop 30 is formed and held in shape by two folded and stitched portions or pleats 24 and 26 having stitching lines 24*a* and 26*a* respectively. The folded and stitched portions 24 and 26 are generally triangular in shape. The stitching lines 24*a* and 26*a* extend generally from a peripheral portion of the flexible sheet 20 and taper towards a central pocket or recess 30*a* of the scoop 30. The folded and stitched portions 24 and 26 are, in the present embodiment, disposed at an obtuse angle of about 120° from each other. The configuration of the scoop 30 is determined by the size, shape, length, and the distance and angle between the two folded and stitched portions 24, 26.

Figure 7:
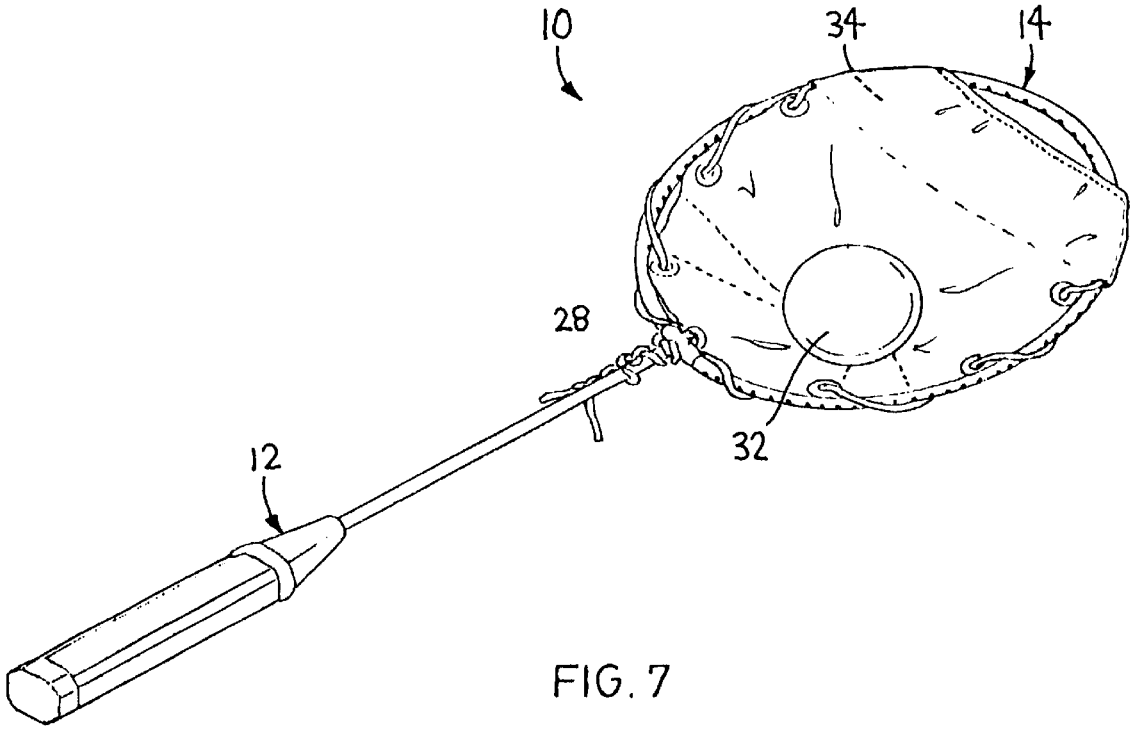
FIG. 7 is a perspective view of the racquet of FIG. 1 showing a ball being caught in the scoop-shaped pocket of the racquet.

The central pocket or recess 30*a* defines a ball catching region for catching a ball 32, as illustrated in FIGS. 4 and 7. It is appreciated that the curvature of the ball catching recess 30*a* generally conforms to the curving shape of the ball 32. According to a preferred embodiment of the present invention, a flexible band or crosspiece 34, preferably made of nylon, is provided on the back side of the head frame 14 at the distal portion 14*b* thereof.

The flexible crosspiece 34 extends transversely across the head frame 14. Both ends of the flexible crosspiece 34 are fastened to respective edges of the flexible scoop 30 by stitching generally along outer walls of the head frame 14, as shown in FIGS. 2 and 4. The flexible crosspiece 34 is of higher tension and provides support at the back of the flexible scoop 30.

When the ball 32 is caught in the central pocket or recess 30*a*, the weight of the ball 32 pulls the flexible scoop 30 and the flexible crosspiece 34 backwards, as best illustrated in FIG. 4.

It can be seen that the central pocket or recess 30*a* becomes shallower towards the distal end portion 14*b* of the head frame 14 thereby defining a first inclined surface or ramp 30*b* along which the ball 32 can be rolled out of the central pocket 30*a* and towards the head frame 14 in a direction, as shown by an arrow in FIG. 4.

A distal end portion of the flexible scoop 30, being supported by the tense crosspiece 34, defines a second inclined surface or ramp 30*c* extending from the first inclined surface or ramp 30*b*. The first and second ramp 30*b*, 30*c* are substantially disposed on a continuously curving and concave surface of the flexible scoop 30. Therefore, the ball 32 can be rolled continuously from the first ramp 30*b*, along the second ramp 30*c* and towards another player or a goal. The second ramp 30*c* which is more tense than the first ramp 30*b* allows the ball 32 to be thrown at a greater velocity and with a greater spin. As a result, the path of the ball is smooth and uninterrupted by the frame.

The racquet 10 of the present invention can be used in a lacrosse-type game or a simple catch and throw game. During the game, a player catches a ball 32 with the flexible scoop 30. The player can throw the ball 32 by an overhead stroke so that the ball 32 is rolled along the first and second ramp 30*b*, 30*c*, out of the scoop 30 and thrown towards another player or a goal. The player can also throw the ball 32 by a forehand stroke or other kinds of strokes.

The distal end opening 18*a* between an exposed distal end section 14*c* of the head frame 14 and the flexible scoop 30 is applied to scoop up a ball from the ground. When the ball 32 is being scooped up by the exposed distal end section 14*c* of the head frame 14, the ball 32 first rolls on top of the opening 18*a* and then into the flexible scoop 30. This prevents any damage to the flexible scoop 30 and the flexible crosspiece 34.

To produce the racquet 10 of the present invention, one can simply make use of and recycle a used stringless racquet. The flexible scoop 30 can be manufactured and custom-made according to the shape, size, and thickness of the head frame of the racquet to be used. It is understood that the flexible sheet 20 must be longer and wider than the head frame 14. The folded and stitched regions 24 and 26 are then produced to form and hold the flexible scoop 30 in shape. The peripheral edges of the flexible sheet 20 are then folded. The folded region 36 is pressed together and is provided with plastic or metal rings 22 by simple fastening or stamping process.

Figure 5:
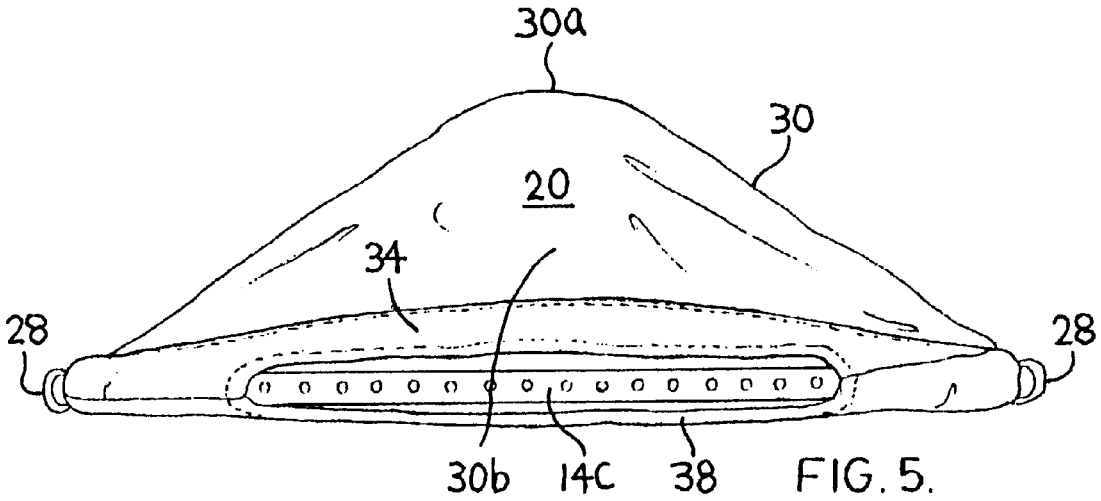
FIG. 5 is an enlarged top view of the racquet of FIG. 1.
Figure 6:
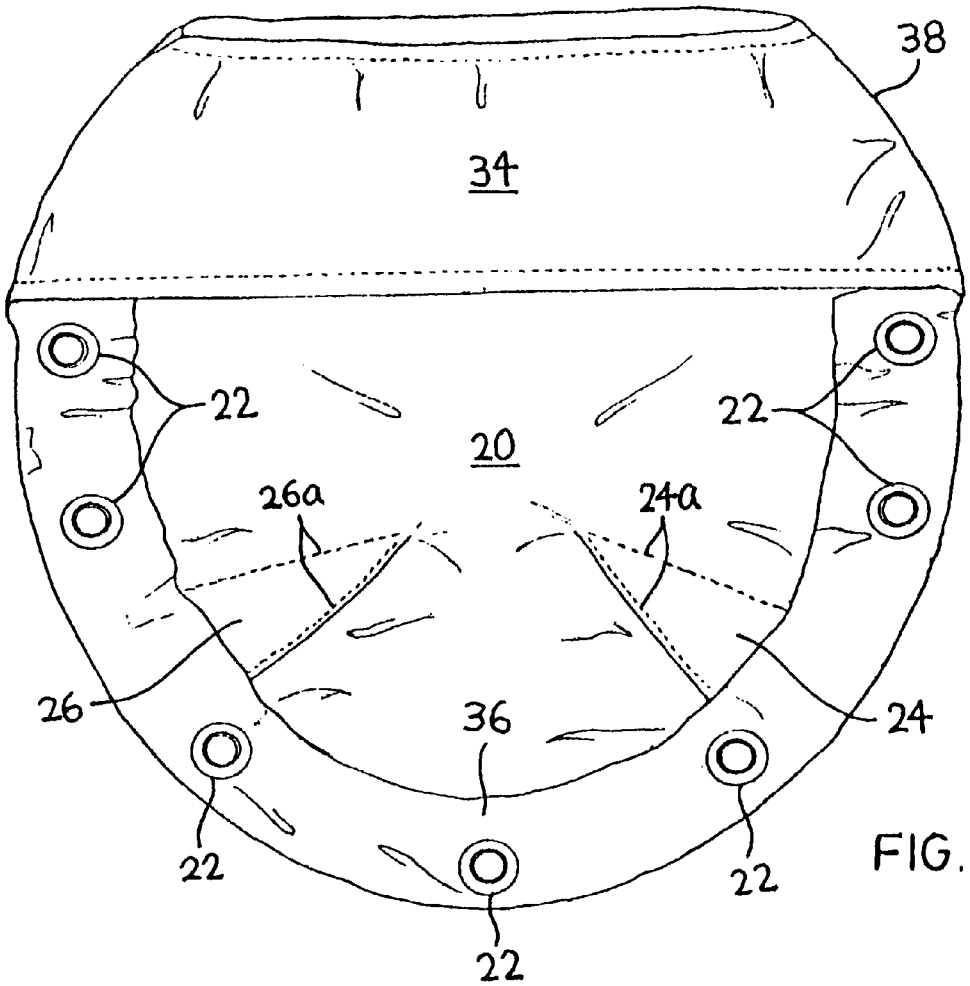
FIG. 6 is an enlarged oblique view of a flexible scoop and crosspiece of the racquet of FIG. 1.

A flexible crosspiece 34 is then stitched to the distal end portion of the flexible scoop 30 to form generally a headband portion 38, as depicted in FIGS. 5 and 6. This headband portion 38 is adapted to fit around the head frame from the distal end portion 14*b* thereof and hold the flexible scoop 30 in a predetermined position relative to the head frame 14. Finally, a string 28 is used to tie the flexible scoop 30 to the head frame 14 thereby producing a lacrosse-type or a catch-and-throw racquet 10 of the present invention.

The racquet 10 of the present invention is easy to produce and maintain in good condition. In case the string 28 is broken, it can be readily replaced by a new string without the necessity of the service of any professional stringers or the use of any specially designed equipment.

Although it has been described that the flexible sheet 20 and the flexible crosspiece 34 are preferably made of nylon, it is understood that the flexible sheet 20 and the flexible crosspiece 34 can be made of any other suitable materials. The flexible sheet 20 and/or the flexible crosspiece 34 can even be in the form of a net.

Although it has been shown that a ball 32 is caught and tossed using one side of the flexible scoop 30, it is appreciated that the other side of the flexible sheet 20 can also be used, for example, in a backhand catching of the ball 32. This can be achieved due to the flexibility of the scoop 30 that is adapted to move from one side of the head frame 14 to the other side.

Furthermore, a space between the flexible scoop 30 and the flexible crosspiece 34 may be adopted to carry a ball 32 if desired.

While the invention has been described to preferred embodiments, many modifications and variations will now occur to persons skilled in the art. For a definition of the invention, reference is made to the appended claims.

What is claimed is:

1. A racquet comprising:

(a) a handle and a head frame, said head frame having a proximal end portion connected to said handle and a distal end portion;

(b) a flexible scoop provided on one side of said head frame, said flexible scoop defining a central pocket and comprises at least one pleat portion for forming said flexible scoop and holding it in shape; and (c) a flexible crosspiece extending across the distal end portion of said head frame for supporting a distal end portion of said flexible scoop on a back side thereof, (d) wherein said flexible scoop defines a first ramp portion along which a ball can be rolled outwardly from said central pocket and towards said head frame, and (e) wherein the distal end portion of said flexible scoop, being supported by said flexible crosspiece, defines a second ramp portion extending from said first ramp portion along which the ball can be rolled continuously from said first ramp portion, along said second ramp portion, and towards a target.

2. A racquet as claimed in claim 1 wherein both ends of said flexible crosspiece are stitched to respective edges of said flexible scoop, thereby generally forming a headband portion adapted to fit around said head frame at the distal end portion thereof and to hold said flexible scoop in a predetermined position relative to said head frame.

3. A racquet as claimed in claim 1 wherein said flexible scoop is fastened to said head frame by means of a string.

4. A racquet as claimed in claim 1 wherein said flexible crosspiece extends transversely across said head frame.

5. A racquet as claimed in claim 1 wherein said flexible scoop and said flexible crosspiece are disposed on a back side of said head frame.

6. A racquet as claimed in claim 1 wherein said first and second ramp portions are substantially disposed on a continuously curving concave surface defined by said flexible scoop.

7. A racquet as claimed in claim 1 wherein the tension of said second ramp portion is higher than the tension of said first ramp portion.

8. A racquet as claimed in claim 1 wherein a distal end section of said head frame is provided to facilitate the scooping up of a ball.

9. A racquet as claimed in claim 1 wherein said head frame is a head frame of a stringless racquet.

10. A racquet as claimed in claim 9 wherein said head frame is a head frame of a used stringless badminton racquet.

11. A racquet as claimed in claim 1 wherein said flexible scoop and said flexible crosspiece are made of nylon.

12. A racquet for use in a catch and throw ball game comprising:

(a) a handle and a head frame, said head frame having a proximal end portion connected to said handle and a distal end portion;

(b) a flexible sheet being longer and wider than said head frame and having string receiving apertures provided along a peripheral portion thereof, said flexible sheet being fastened within said head frame, thereby forming a flexible scoop on one side of said head frame for catching and throwing a ball; and (c) a flexible crosspiece extending across the distal end portion of said head frame for supporting a distal end portion of said flexible scoop on a back side thereof, wherein said flexible scoop define at least one ramp portion along which a ball can be rolled.

13. A racquet as claimed in claim 12 wherein both ends of said flexible crosspiece are stitched to respective edges of said flexible sheet thereby forming a headband portion adapted to fit around head frame at the distal end portion thereof and to hold said flexible scoop in a predetermined position relative to said head frame.

14. A racquet as claimed in claim 12 wherein said flexible sheet is fastened to said head frame by means of a string threading through each of said string receiving apertures and winding around a section of said head frame alternately.

15. A racquet as claimed in claim 12 wherein at least one portion of said flexible sheet is folded and stitched together so as to form said flexible scoop and to hold it in shape.

16. A racquet as claimed in claim 12 wherein at least one portion of said flexible sheet is folded and stitched together proximate the proximal end portion of said head frame.

17. A racquet as claimed in claim 15 wherein said at least one folded and stitched portion extends from a peripheral portion of said flexible sheet and tapers generally towards a central portion of said flexible scoop.

18. A racquet as claimed in claim 12 wherein said flexible crosspiece extends transversely across said head frame.

19. A racquet as claimed in claim 12 wherein said flexible scoop and said flexible crosspiece are disposed on a back side of said head frame.

20. A racquet as claimed in claim 12 wherein a distal end section of said head frame is adapted to facilitate the scooping up of a ball.

21. A racquet as claimed in claim 12 wherein said head frame is a head frame of a stringless racquet.

22. A racquet as claimed in claim 21 wherein said head frame is a head frame of a used stringless badminton racquet.

23. A racquet as claimed in claim 12 wherein said flexible sheet and said flexible crosspiece are made of nylon.

24. A method of producing a racquet comprising the steps of:

(a) providing a stringless racquet with a handle and a head frame having a proximal end portion and a distal end portion;

(b) providing a flexible sheet with string receiving apertures formed along a peripheral portion thereof, said flexible sheet being longer and wider than said head frame;

(c) folding and stitching at least a portion of said flexible sheet together to form a flexible scoop;

(d) stitching both ends of a flexible crosspiece to opposite edges of said flexible scoop thereby forming generally a headband portion;

(e) fitting said headband portion around said head frame from the distal end portion thereof thereby holding said flexible scoop in a predetermined position relative to said head frame; and (f) fastening said flexible scoop to said head frame by means of a string.

25. A method as claimed in claim 24 wherein said fastening step further comprises the steps of threading said string through each of said string receiving apertures and winding said string around a section of said head frame alternately.

26. A method as claimed in claim 24 wherein said flexible crosspiece extends transversely across said head frame at a back side thereof.

27. A method as claimed in claim 26 wherein said flexible scoop is adapted to be positioned at the back side of said head frame in such a manner that a distal end portion of said flexible scoop is supported by said flexible crosspiece.

28. A method as claimed in claim 24 wherein said stringless racquet is a used stringless badminton racquet.

29. A method as claimed in claim 24 wherein said flexible sheet and said flexible crosspiece are made of nylon.

* * * * *